US010743687B2

(12) United States Patent
Doty

(10) Patent No.: US 10,743,687 B2
(45) Date of Patent: Aug. 18, 2020

(54) ARCUATE SUPPORT PILLOW WITH DETACHABLE HOOD

(71) Applicant: John K. Doty, Henderson, NV (US)

(72) Inventor: John K. Doty, Henderson, NV (US)

( * ) Notice: Subject to any disclaimer, the term of this patent is extended or adjusted under 35 U.S.C. 154(b) by 193 days.

(21) Appl. No.: 16/010,328

(22) Filed: Jun. 15, 2018

(65) Prior Publication Data

US 2018/0360242 A1 Dec. 20, 2018

Related U.S. Application Data

(60) Provisional application No. 62/522,569, filed on Jun. 20, 2017.

(51) Int. Cl.

| | |
|---|---|
| ***A47G 9/10*** | (2006.01) |
| ***A42B 1/04*** | (2006.01) |
| ***A42B 1/24*** | (2006.01) |
| ***A42B 1/20*** | (2006.01) |
| *A47G 9/00* | (2006.01) |

(52) U.S. Cl.

CPC ..... *A47G 9/1045* (2013.01); *A42B 1/041* (2013.01); *A42B 1/048* (2013.01); *A42B 1/203* (2013.01); *A42B 1/24* (2013.01); *A47G 9/1027* (2013.01); *A47G 9/1081* (2013.01); *A47G 2009/006* (2013.01)

(58) Field of Classification Search

CPC .. A47G 9/1045; A47G 9/1081; A47G 9/1027; A47G 2009/006; A47G 2009/1018; A41D 2400/14; A42B 1/048; A42B 1/203

See application file for complete search history.

(56) References Cited

U.S. PATENT DOCUMENTS

| | | | | |
|---|---|---|---|---|
| 6,649,251 | B1 * | 11/2003 | Druecke | A41D 3/00 428/198 |
| 6,651,256 | B1 * | 11/2003 | Swift | A42B 1/004 2/15 |
| 7,657,954 | B1 * | 2/2010 | Bunkers | A42B 1/048 2/202 |
| 8,990,980 | B1 * | 3/2015 | Hindley | A61G 99/00 5/490 |
| 2004/0199998 | A1 * | 10/2004 | Shinner | A47G 9/0223 5/482 |
| 2013/0125312 | A1 * | 5/2013 | Harooni | A47C 7/383 5/639 |
| 2019/0029339 | A1 * | 1/2019 | Yang | A41D 1/02 |
| 2019/0070439 | A1 * | 3/2019 | Namm | A62B 17/04 |

FOREIGN PATENT DOCUMENTS

| | | | | |
|---|---|---|---|---|
| CN | 203934946 U | * | 11/2014 | |
| CN | 207306496 U | * | 5/2018 | A47C 7/383 |
| TW | M472421 U | * | 2/2014 | H01L 33/0016 |

OTHER PUBLICATIONS

Grand Trunk Hooded Neck Pillow; Amazon.ca product; https://www.amazon.ca/Grand-Trunk-Blackout-Hooded-Pillow/dp/B009CSMGSK/ref=sr_1_fkmr1_1?dchild=1&keywords=grand%2Btrunk%2Bhooded%2Bneck%2Bpillow&qid=1582127604&sr=8-1-fkmr1&th=1; accessed on Feb. 14, 2020; dated Nov. 23, 2016. (Year: 2016).*

* cited by examiner

*Primary Examiner* — Daniel J Colilla
(74) *Attorney, Agent, or Firm* — Steven Rinehart

(57) ABSTRACT

A novel pillow with a detachable hood comprising a drawstring for providing comfort, privacy, sound dampening, and protection to a user. The pillow comprises an arcuate bladder and upper half hood which may be hemispherical or semi-hemispherical. The pillow may be inflatable or stuffed.

1 Claim, 4 Drawing Sheets

ARCUATE SUPPORT PILLOW WITH DETACHABLE HOOD

FIELD OF THE INVENTION

This invention relates to pillows and bedding, and more particularly relates to inflatable portable pillows for nursing, supporting children, camping and traveling.

BACKGROUND

Description of the Related Art

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

Pillows in the art typically are stuffed with memory foam, feathers, cotton, wool beans, microbeads and the like. Originally pillows were square, then rectangular, and now come in a variety of shapes and sizes.

Travelers who remain largely immobile for unusual periods of time experience frequent discomfort through the neck region as do drivers of automobiles and trucks and children reading books or taking naps on the go. Campers frequently have insufficient pillow items given the bulk and weight of traditional pillows.

Although pillows have also been known for decades in the art and are commonly used for traveling because they are lightweight and not cumbersome when deflated, they suffer from a number defects and inefficiencies. Traditional pillows do not fully support the head, often supporting on the neck. Traditional pillows do no provide warmth to the head region, or privacy when being stared at. Traditional pillow are not multiconfigurable, and do not have detachable hoods, nor do they separate into two usable portions.

It is therefore desirable to provide a pillow which cures these defects. It is an object of the present invention to provide a pillow which remedies these inefficiencies in the art.

SUMMARY

From the foregoing discussion, it should be apparent that a need exists for an inflatable arcuate support pillow with detachable hood. Beneficially, such a pillow would provide means of curing the deficiencies in the prior art described above.

The present invention has been developed in response to the present state of the art, and in particular, in response to the problems and needs in the art that have not yet been fully solved by currently available pillows. Accordingly, the present invention has been developed to provide an inflatable support pillow comprising: a crescent-shaped first inflatable bladder adapted to support the head and neck of user; a detachable hood comprising: an arcuate second inflatable bladder detachably affixable to the first inflatable bladder defining an interior channel through which a drawstring travels; a drawstring received by the interior channel adapted to pull the hood taught around a user's head.

The hood of the inflatable pillow may further comprise padding lining an interior surface.

The inflatable support pillow, in some embodiments, further comprises one or more speakers for playback of media during pillow use.

The interior channel may be formed by folding a polymeric sheet back over itself.

In various embodiments, the hood is attached to the first inflatable bladder using Velcro®.

An exterior surface of the hood may be contoured to resemble an animal.

An exterior surface of the hood may be printed to resemble an animal.

A second support pillow is provided comprising: a crescent-shaped first inflatable bladder adapted to support the head and neck of user; a detachable hood comprising: an arcuate second bladder detachably affixable to the first inflatable bladder defining an interior channel through which a drawstring travels; a drawstring received by the interior channel adapted to pull the hood taught around a user's head.

The hood may further comprise padding lining an interior surface.

The support pillow, in some embodiments, further comprises one or more speakers for playback of media during pillow use.

The interior channel may be formed by folding a polymeric sheet back over itself. The hood may be attached to the first inflatable bladder using Velcro®.

In some embodiments, an exterior surface of the hood is contoured to resemble an animal. Alternatively, an exterior surface of the hood may be printed to resemble an animal.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided, such as examples of programming, software modules, user selections, network transactions, database queries, database structures, hardware modules, hardware circuits, hardware chips, etc., to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

It an object of the present invention to provide a novel inflatable pillow with a detachable inflatable hood comprising a drawstring for providing comfort, privacy, sound dampening, and protection to a user. The inflatable pillow may comprise an arcuate inflatable bladder and upper half hood which may be hemispherical or semi-hemispherical.

Figure 1:
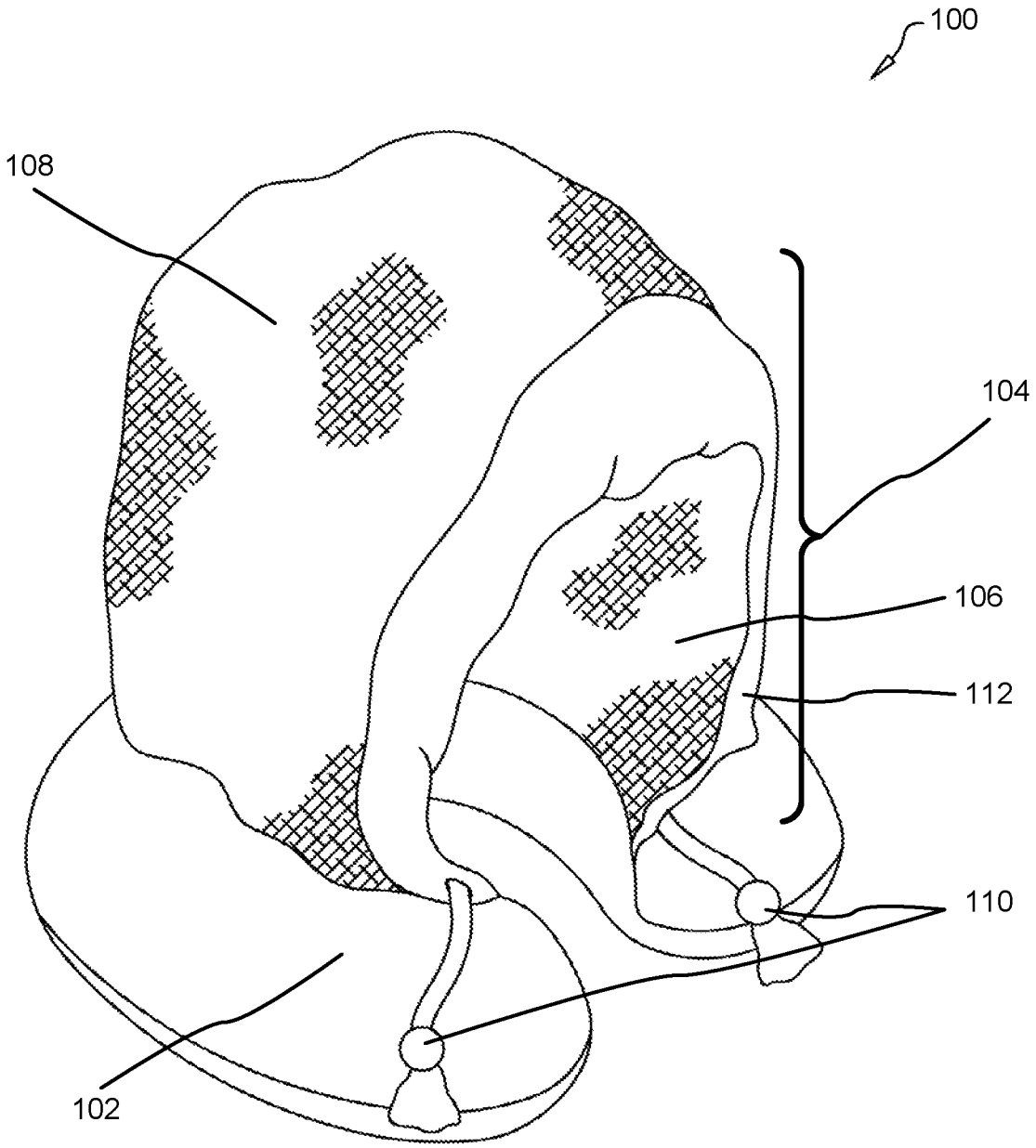
FIG. 1 is a forward side perspective view of an arcuate support pillow with detachable hood in accordance with the present invention.

FIG. 1 is a forward side perspective view of an arcuate support pillow with detachable hood 100 in accordance with the present invention.

The pillow 100 comprises an arcuate, or crescent, or U-shaped, inflatable bladder or main pillow portion 102 adapted to rest pressurized with ambient air and the support the weight of the neck, head and upper torso of a user.

The bladder 102 may be stuffed with memory foam, beams, feathers, or any other material known to those of skill in the art. Alternatively, the bladder 102 may be inflatable.

The bladder 102 may be formed from any polymeric or organic material known to those of skill in the art, such nylon or leather. The bladder 102 may be coated or fabricated from waterproof or water-resistant materials such as those sold by Sonobond™.

The pillow 100 comprises a detachable hood 104 which comprises a hemispherical, semi-hemispherical or arcuate second bladder 108, which may be inflatable or stuffed using means known to those of skill in the art. The bladder 108 may envelope or partially envelope the head of a user rests his head on the bladder 102, providing privacy or even sound/snoring dampening functionality.

The detachable hood 104 is detachably affixable to the arcuate bladder 102 using means known to those of skill in the art, including snaps, zippers, and/or Velcro®. In the shown embodiment, the hood 104 detachably affixes to the bladder 102 using Velcro®.

The hood 104 comprises an interior channel through which a drawstring 110 traverses. The drawstring 110 is adapted to be pulled to draw in the outer edge 112 of the hood 104. In this manner, the drawstring 110 may be pulled covering the head of a user for warm, privacy or protection.

The hood 104 may comprises padding 106, including memory foam, lining the interior surface of the hood 104 as shown. The padding 106 may help with comfort, insulation, sound proofing, and the like.

The various embodiments, the second bladder 108 detachably affixed to an inseam at the top of the first bladder 102.

Figure 2:
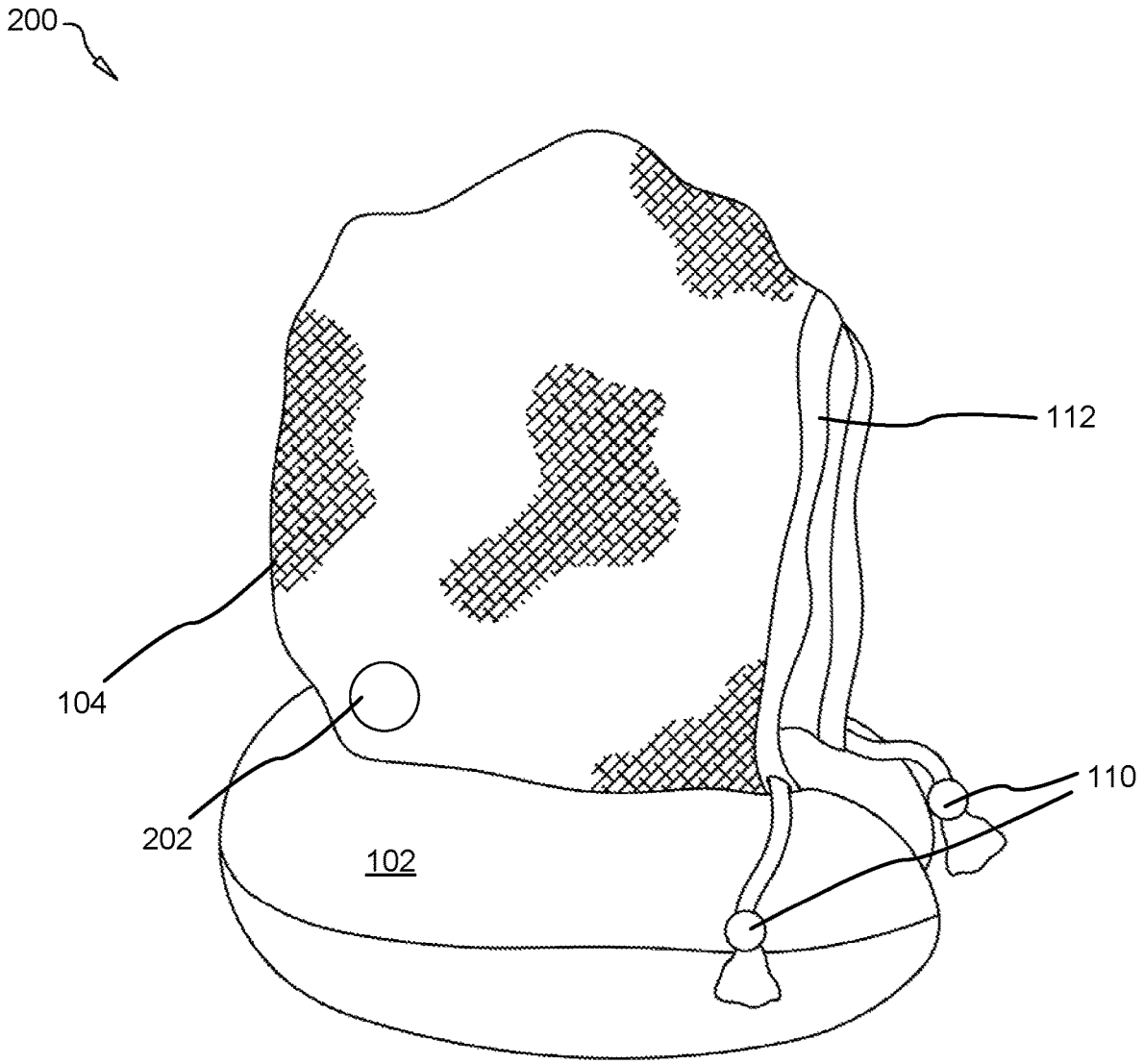
FIG. 2 is a side perspective view of an arcuate support pillow with detachable hood in accordance with the present invention.

FIG. 2 is a side perspective view of an arcuate support pillow with detachable hood 200 in accordance with the present invention.

In various embodiments, the outer edge 112 of the hood 104 comprises a polymeric sheet folded back over itself and sealed or heat pressed to form the interior channel through which the drawstring 110 travels.

The hood 104 may define one or more holes 202 traverse the inner and outer surfaces through which a pony tail of wearer insert or transition.

Figure 3:
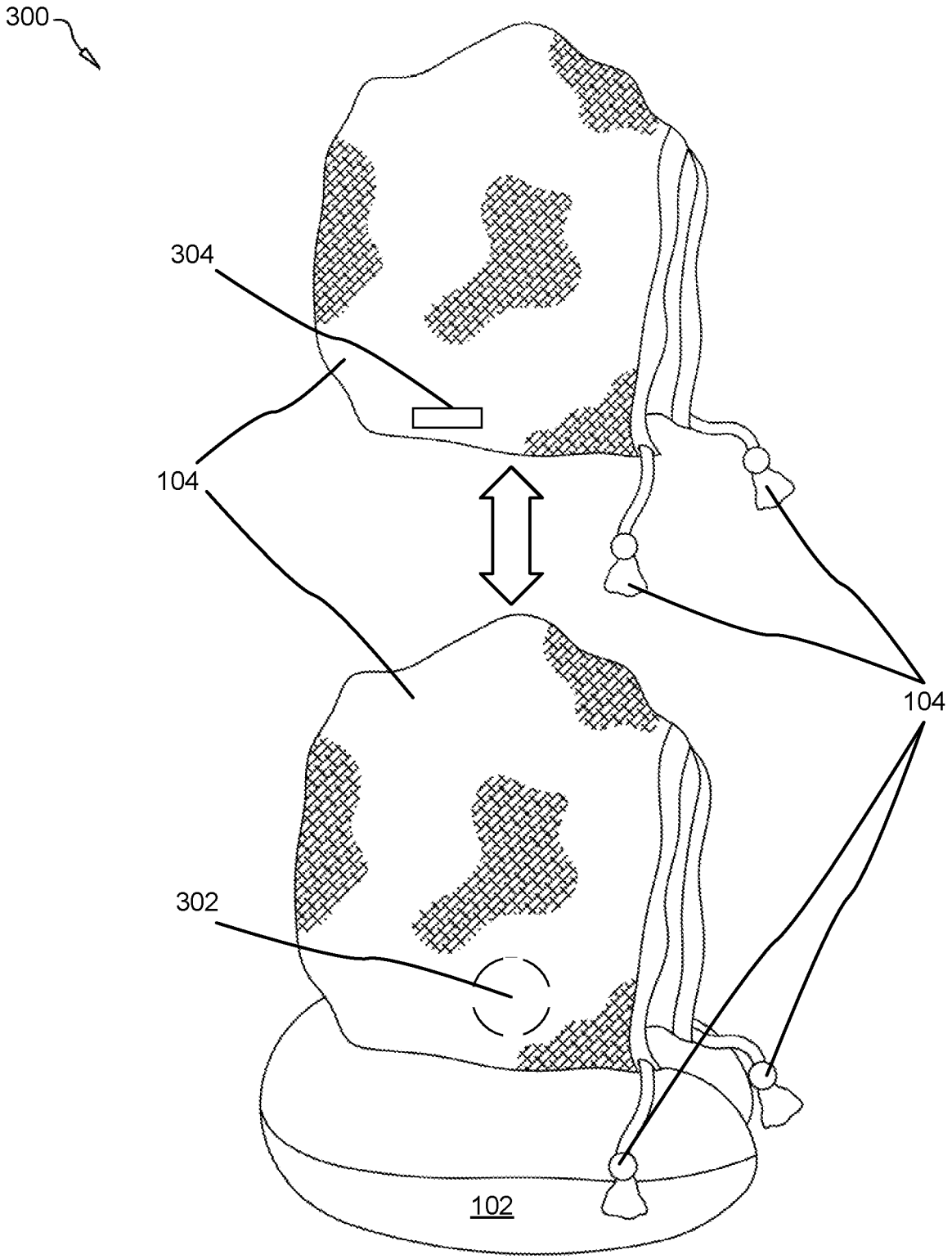
FIG. 3 is a side perspective view of an arcuate support pillow with detached hood and attached hood in accordance with the present invention.

FIG. 3 is a side perspective view of an arcuate support pillow with detached hood and attached hood 300 in accordance with the present invention.

The pillow 300 may comprise two detachable hoods 104 or a single detachable hood. The detachable hood 104 itself may be adapted for use a second pillow by a second traveler accompanying the first traveler in detached form. The detachable hood 104 alternatively may affix as described above the inflatable bladder 102.

The hoods 104 may comprise a speaker 302. In various embodiments of the present invention, the hood 104 is adapted to interconnect with a media playing device and play audio to a user of the pillow 300. The pillow 300 may also comprise a power supply, wireless connectivity components, cables and other components necessary to impart media playback functionality to the pillow 300.

In various other embodiments, the pillow 300 comprises other electronic devices known to those of skill in the art, including a sleep mask having CPAP function or oxygen dispensing means.

The pillow 300 may also comprise one of a plurality of protective masks, such as a hockey or football mask.

Velcro® pad 304 may affix to the hood 104.

Figure 4:
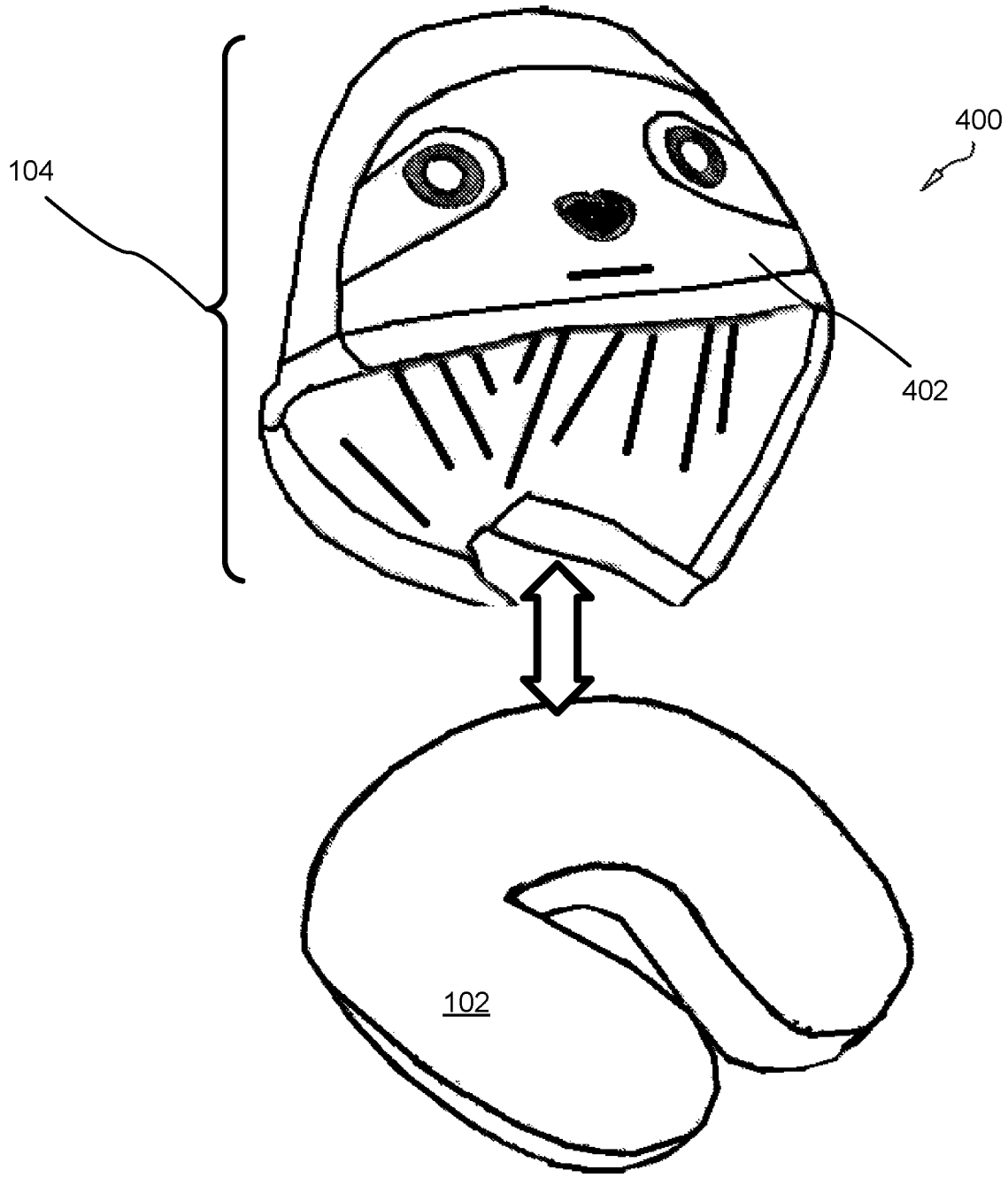
FIG. 4 is a side perspective view of an arcuate support pillow with detached animal hood in accordance with the present invention.

FIG. 4 is a side perspective view of an arcuate support pillow with detached animal hood 400 in accordance with the present invention.

To appeal to children and toddler, the hood 104 of the pillow may be shaped (which exterior surface contouring) or printed to resemble or depict an animal's head, in the shown example the head of bear 402. In other embodiments, the pillow may depict a wolf, superhero, dinosaur, dog, cat, mouse, or other animal character of appeal to children.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An inflatable support pillow comprising:

a crescent-shaped first inflatable bladder coated with waterproof material adapted to support the head and neck of user;

a plurality of detachable hoods, each detachable hood comprising:

an arcuate second inflatable bladder detachably affixable to the first inflatable bladder defining an interior channel through which a drawstring travels;

wherein the interior channel is formed by folding a polymeric sheet back over itself;

a drawstring received by the interior channel adapted to pull the hood taught around a user's head;

wherein the hood further comprises padding lining an interior surface;

one or more speakers for playback of media during pillow use.

* * * * *